US006004901A

United States Patent [19]

Burns et al.

[11] Patent Number: 6,004,901

[45] Date of Patent: Dec. 21, 1999

[54] THERMAL DYE TRANSFER RECEIVING ELEMENT

[75] Inventors: Elizabeth G. Burns; Kristine B. Lawrence, both of Rochester, N.Y.

[73] Assignee: Eastman Kodak Company, Rochester, N.Y.

[21] Appl. No.: 09/022,180

[22] Filed: Feb. 11, 1998

[51] Int. Cl.[6] ..... B41M 5/035; B41M 5/38

[52] U.S. Cl. ..... 503/227; 428/195; 428/447; 428/480; 428/913; 428/914

[58] Field of Search ..... 8/471; 428/195, 428/447, 480, 913, 914; 503/227

[56] References Cited

U.S. PATENT DOCUMENTS

| | | | |
|---|---|---|---|
| 5,250,494 | 10/1993 | Wehrmann et al. | 503/227 |
| 5,317,001 | 5/1994 | Daly et al. | 503/227 |

*Primary Examiner*—Bruce H. Hess
*Attorney, Agent, or Firm*—Harold E. Cole

[57] ABSTRACT

A dye-receiving element for thermal dye transfer comprising a support having on one side thereof a dye image-receiving layercomprising a water-dispersible polyester comprising 3 to 20 wt-% carbinol-terminated dimethylsiloxane.

20 Claims, No Drawings

THERMAL DYE TRANSFER RECEIVING ELEMENT

FIELD OF THE INVENTION

This invention relates to dye-receiving elements used in thermal dye transfer, and more particularly to polyester dye image-receiving layers for such elements.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dye receiving elements used in thermal dye transfer generally include a support (transparent or reflective) bearing on one side thereof a dye image-receiving layer, and optionally additional layers. The dye-receiving layer comprises a polymeric material chosen from a wide assortment of compositions and should have good affinity for the dye. Dyes must migrate rapidly into the layer during the transfer step and become immobile and stable in the viewing environment. One way to immobilize the dye in the receiving element is to transfer a laminate layer from the donor element to the receiver after the image has been generated. The dye-receiving layer must also not stick to the hot donor during the printing process, otherwise the final image will be damaged due to either the donor or receiver tearing while peeling apart after the printing step. One way to prevent donor-receiver sticking is to apply an overcoat layer or to add release agents to the receiver layer. The overcoat would require a separate coating step which increases manufacturing costs of the dye-receiving element and addition of release agents increases the media costs.

DESCRIPTION OF RELATED ART

U.S. Pat. No. 5,317,001 describes thermal dye transfer to a receiver element. The dye-receiving layer is described as comprising a water-dispersible polyester. These materials are aqueous coatable and were found to provide good image-receiving layer polymers because of their effective dye-compatibility and receptivity. However, there is a problem with this material in that severe donor-receiver sticking occurs during the printing process.

U.S. Pat. No. 5,250,494 describes a dye-acceptor element for thermal sublimation printing. The dye-acceptor layer is described as being a polyester formed from diols which contain long-chained fatty acid-derived materials and dicarboxylic acids. However, there is a problem with these materials in that they are not water-dispersible and have to be coated from a solvent which has environmental problems.

It is an object of this invention to provide a receiver element for thermal dye transfer processes with a dye image-receiving layer that is water-coatable. It is another object of the invention to provide a receiver element for thermal dye transfer processes which will not stick to the donor during the printing process.

SUMMARY OF THE INVENTION

These and other objects are achieved in accordance with this invention which comprises a dye-receiving element for thermal dye transfer comprising a support having on one side thereof a dye image-receiving layer comprising a water-dispersible polyester comprising 3 to 20 wt-% carbinol-terminated dimethylsiloxane.

The polyesters employed in accordance with the invention were found to improve water dispersibility relative to long-chained fatty acid-derived materials and minimized donor-receiver sticking during printing.

DESCRIPTION OF THE PREFERRED EMBODIMENTS

In a preferred embodiment of the invention, the polyester polymers are condensation type polyesters having the following structure:

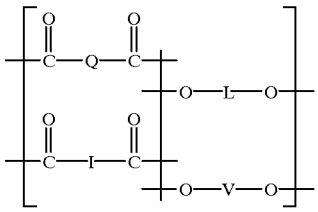

wherein:

Q represents an alkyl dicarboxylic acid, an aromatic dicarboxylic acid or one or more alicyclic rings containing dicarboxylic acid units with each carboxyl group within two carbon atoms (preferably adjacent) of the alicyclic ring; comprising 70 to 90 mole-% of the dibasic diacid repeat units;

I represents an ionic dibasic dicarboxylic acid and comprises 30 to 10 mole-% of the dibasic diacid repeat units;

V represents a carbinol-terminated polydimethylsiloxane segment, where the mole-% is sufficient to yield a final polymer with 3 to 20 wt-% polydimethylsiloxane; and L comprises the balance of the mole-% and represents an alkylene diol, one or more aromatic rings with a hydroxyl group within two carbon atoms (preferably adjacent) of the aromatic ring, or one or more alicyclic rings with a hydroxyl group within two carbon atoms (preferably adjacent) of the alicyclic ring.

In a preferred embodiment of the invention, the polyester polymers used in the dye-receiving elements of the invention are condensation type polyesters based upon recurring units derived from alicyclic dibasic acids (Q) and diols, wherein (Q) represents one or more alicyclic ring containing dicarboxylic acid units with each carboxyl group within two carbon atoms of (preferably immediately adjacent) the alicyclic ring. Preferably, at least 30 mole % of the diol derived units are derived from diols of the group (L) comprising diol units containing at least one aromatic ring not immediately adjacent to (preferably from 1 to about 4 carbon atoms away from) each hydroxyl group or an alicyclic ring which may be adjacent to the hydroxyl groups. For the purposes of this invention, the terms "dibasic acid derived units" and "dicarboxylic acid derived units" are intended to define units derived not only from carboxylic acids themselves, but also from equivalents thereof such as acid chlorides, acid anhydrides and esters, as in each case the same recurring units are obtained in the resulting polymer. Each alicyclic ring of the corresponding dibasic acids may also be optionally substituted, e.g. with one or more alkyl groups having from 1 to 4 carbon atoms. Each of the diols may also optionally be substituted on the aromatic or alicyclic ring, e.g. by alkyl groups having from 1 to 6 carbon atoms, alkoxy, or halogen.

In a further preferred embodiment of the invention, at least 20 mole % of the diol derived units of the polyester contain an alicyclic ring.

In another embodiment of the invention, the alicyclic rings of the dicarboxylic acid derived units and diol derived units contain from 4 to 10 ring carbon atoms. In a particularly preferred embodiment, the alicyclic rings contain 6 ring carbon atoms.

The alicyclic dicarboxylic acid units, (Q), are represented by structures such as:

Q1:

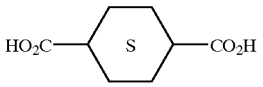

Q2:

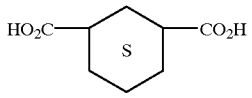

Q3:

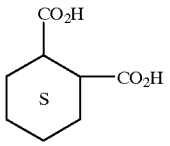

Q4:

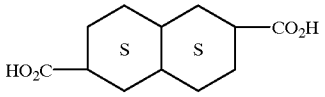

Q5:

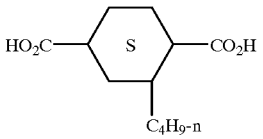

Q6:

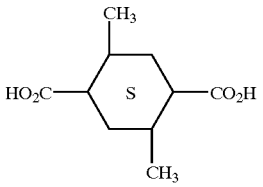

-continued

Q7:

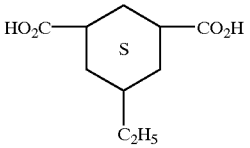

Q8:

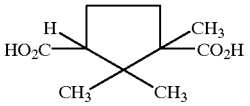

Q9:

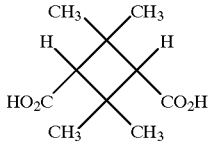

Q10:

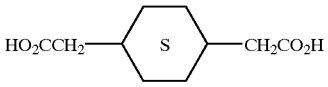

Q11:

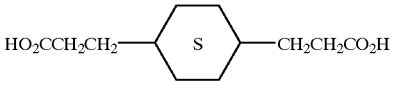

Q12:

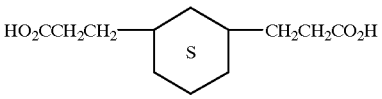

I in the above formula represents an ionic dibasic dicarboxylic acid which contains metal ion salts of sulfonic acids or iminodisulfonyl groups. Examples of such ionic monomers include those represented by structures such as:

I1:

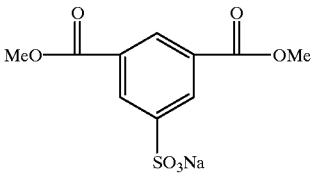

I2:

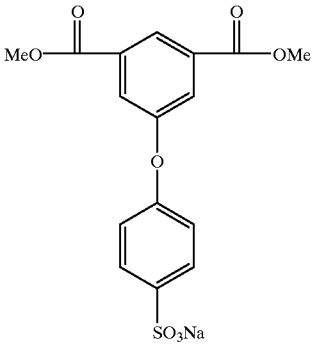

-continued
I3:
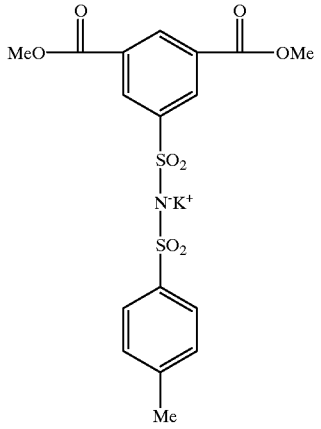
I4:
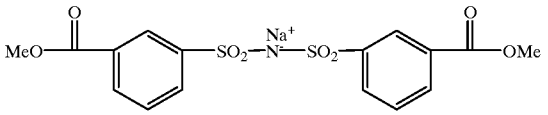
Preferred diols L in the above formula are represented by cyclic structures such as:
L1:
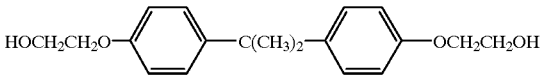
L2:
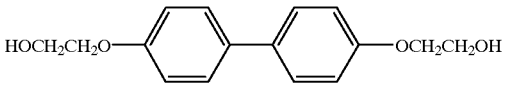
L3:
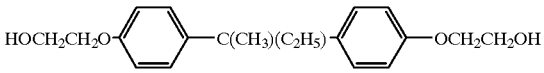
L4:
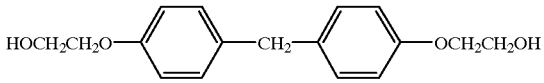
L5:
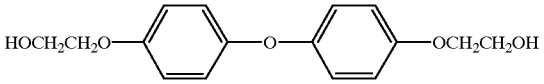
L6:
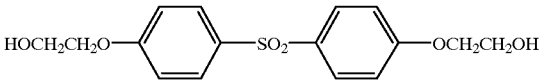
L7:
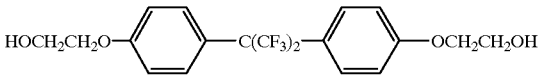
L8:
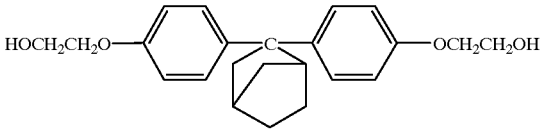
-continued
L9:
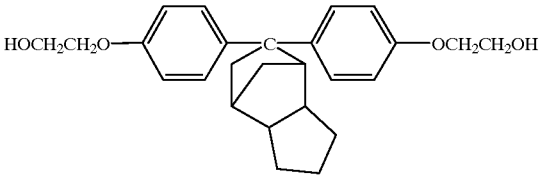
L10:
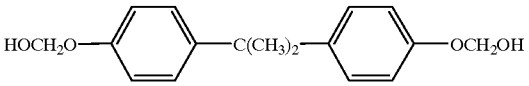
L11:
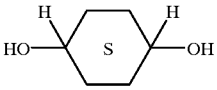
L12:
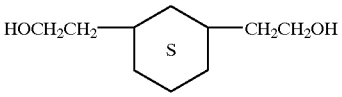
L13:
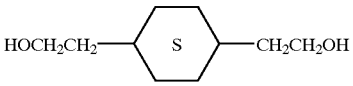
L14:
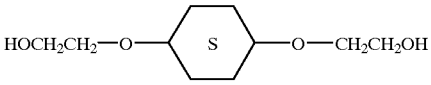
L15:
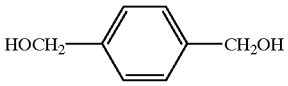
L16:
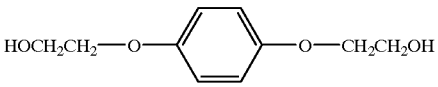
L17:
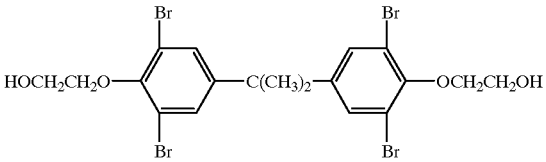
L18:
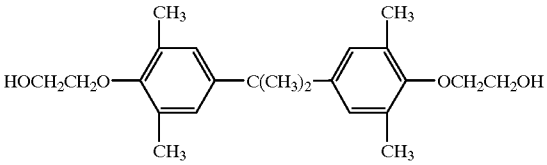
L19:
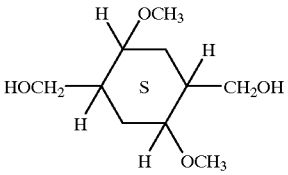

-continued

L20:

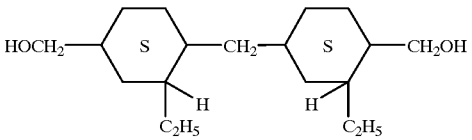

L21:

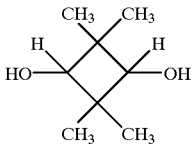

L22:

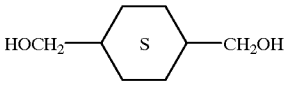

L23:

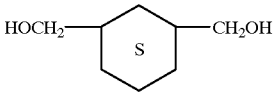

In a preferred embodiment of the invention, the carbinol-terminated polydimethylsiloxane segment (V) has the following formula:

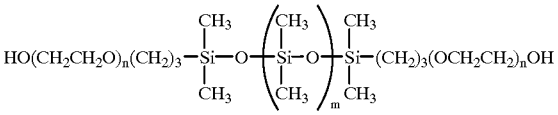

wherein n and m are selected so that the molecular weight is between 500 and 10,000 and the weight % of nonsiloxane components is between 2 and 25.

Optionally other groups, R and M, may be copolymerized to produce preferred structures such as:

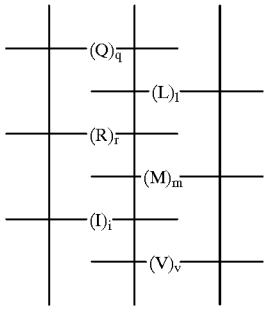

wherein q+r+i=1+m+v=100 mole %, q is at least 50 mole %, i is preferably from about 5 to about 40 mole % (more preferably from about 8 to 28 mole %), and 1 is preferably at least 20 mole %. At lower levels of ionomer modification (e.g., i less than 5 mole %), the polyesters are difficult to disperse in water. At higher levels of ionomer (e.g., i greater than 40 mole %), the melt viscosity increases to a level such that synthesis becomes difficult.

Diesters R and diols M may be added, e.g., to precisely adjust the polymer's Tg, solubility, adhesion, etc. Additional diester comonomers could have the cyclic structure of Q or be linear aliphatic units. The additional diol monomers may have aliphatic or aromatic structure but are not phenolic.

Suitable groups for R include dibasic aliphatic acids such as:

R1: $HO_2C(CH_2)_2CO_2H$
R2: $HO_2C(CH_2)_4CO_2H$
R3: $HO_2C(CH_2)_7CO_2H$
R4: $HO_2C(CH_2)_{10}CO_2H$

Suitable groups for M include diols such as:

M1: $HOCH_2CH_2OH$
M2: $HO(CH_2)_4OH$
M3: $HO(CH_2)_9OH$
M4: $HO(CH_2)_8OH$
M5: $HO(CH_2)_{10}OH$
M6: $HO(CH_2)_{12}OH$
M7: $HOCH_2C(CH_3)_2CH_2OH$
M8: $(HOCH_2CH_2)_2O$
M9: $HO(CH_2CH_2O)_nH$ (where n=2 to 50)

The polyester employed in the invention preferably has a Tg between about 0° C. and about 120° C., preferably between about 0° C. and 60° C. Higher Tg polyesters may be useful with added plasticizer. In a preferred embodiment of the invention, the polyesters have a number molecular weight of from about 10,000 to about 250,000, more preferably from about 20,000 to about 100,000.

Following are examples of polyester polymers useful in the receiving layer of the invention:

TABLE 1

8 mole % 5-sulfoisophthalate, Na salt, (DuPont Corp.)
42 mole % cyclohexanedicarboxylate
n mole % carbinol-terminated polydimethylsiloxane
50 - n mole % cyclohexane dimethanol, where n is adjusted to yield the desired wt % of siloxane

| | | Carbinol-Terminated Polydimethylsiloxane | | |
|---|---|---|---|---|
| Example | Polymer Tg (° C.) | Name | Molecular Weight | Wt % |
| E-1 | 44 | DMS-C15* | 1219 | 4 |
| E-2 | 44 | DMS-C15 | 1219 | 6 |
| E-3 | 40 | DMS-C15 | 1219 | 8 |
| E-4 | 42 | DMS-C21* | 4500–5500 | 4 |
| E-5 | 53 | DMS-C21 | 4500–5500 | 6 |
| E-6 | 56 | DMS-C21 | 4500–5500 | 8 |

*available from Gelest, Inc. Tulleytown, PA.

* available from Gelest, Inc. Tulleytown, Pa.

The support for the dye-receiving element of the invention may be transparent or reflective, and may be a polymeric, a synthetic paper, or a cellulosic paper support, or laminates thereof. In a preferred embodiment, a paper support is used. In a further preferred embodiment, a polymeric layer is present between the paper support and the dye image-receiving layer. For example, there may be employed a polyolefin such as polyethylene or polypropylene. In a further preferred embodiment, white pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150; 4,965,238; 4,965,239; and 4,965241, the disclosures of which are incorporated by reference. The receiver element may also include a backing layer such as those disclosed in U.S. Pat. Nos. 5,011,814 and 5,096,875, the disclosures of which are incorporated by reference.

The dye image-receiving layer may be present in any amount which is effective for its intended purpose. In general, good results have been obtained at a receiver layer concentration of from about 0.5 to about 10 g/m$^2$.

Dye-donor elements that are used with the dye-receiving element of the invention conventionally comprise a support having thereon a dye containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112; 4,927,803 and 5,023,228, the disclosures of which are incorporated by reference.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. Alternatively, other known sources of energy for thermal dye transfer may be used, such as lasers as described in, for example, GB 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart A second dye-donor element (or another area of the donor element with a different dye area) is then brought in register with the dye-receiving element and the process repeated. The third color is obtained in the same manner.

The following examples are provided to illustrate the invention.

EXAMPLES

The following dyes were used in the experimental work:

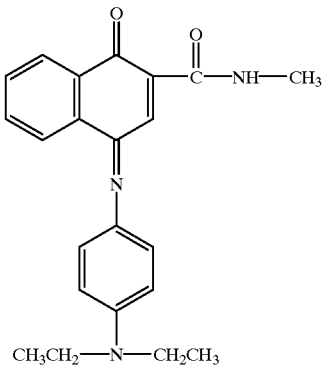

Cyan Dye 1

-continued

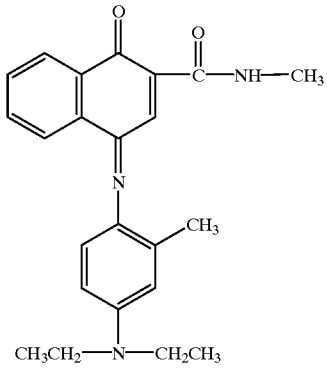

Cyan Dye 2

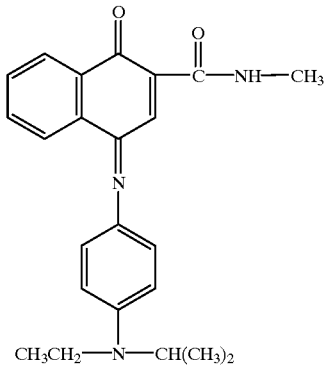

Cyan Dye 3

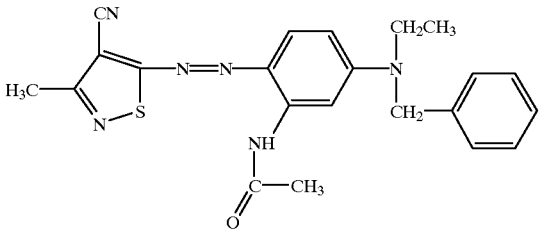

Magenta Dye 1

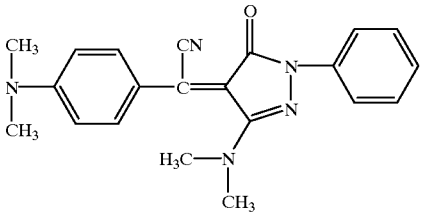

Magenta Dye 2

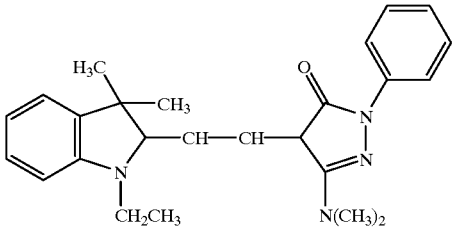

Yellow Dye 1

Example 1

Preparation of Control and Invention Polyesters

Table 1 above summarizes the composition of the invention polymers (E1 through E6) useful in the receiver layer of this invention. Tables 2 and 3 list the control polymers for this invention; CP-1 is analogous to P-1 of U.S. Pat. No. 5,317,001 and CP-2 through CP-5 analogous to those described in U.S. Pat. No. 5,250,494.

The same method was used for the synthesis of control polymers (CP-1 through CP-5) and polymers of the invention (E-1 through E6). The mole-% of carbinol-terminated dimethylsiloxane segments was calculated to give the desired wt-%, the balance of the diols being cyclohexanedimethanol. Dimethyl esters of the desired dicarboxylate linkages were used. Monomers (0.50 moles total monomer charge) were weighed into a 250 mL round-bottom, long-necked flask. A take-off arm was attached to the top of the flask. Under a nitrogen stream, the monomers were first melted at 250° C., then the molten monomers were purged with nitrogen. Antimony pentoxide, 0.5 mL of a 6% dispersion in ethylene glycol, was added. Five drops of neat titanium isopropoxide were added, and the resulting methanol distillate was collected. After two hours, a vacuum manifold and a stir paddle was attached to the flask, and a vacuum applied with stirring. The reaction continued for two hours under vacuum. The flask was then allowed to cool to room temperature for 30 minutes, before the vacuum was released. Polymers were isolated by freezing the flasks in liquid nitrogen and breaking the flask.

TABLE 2

Compositions of Control Polyesters

| Ex. | mole % tere-phthalate | mole % isophthalate | mole % 5-sulfoiso phthalate | mole % ethylene glycol | mole % Dianol 220 ®* | mole % Pripol 2033 ®** |
|---|---|---|---|---|---|---|
| CP-1 | 0 | 0 | 8 | 0 | 0 | 0 |
| CP-2 | 22.5 | 22.5 | 5 | 55 | 10 | 2.5 |
| CP-3 | 22.5 | 21.25 | 6.25 | 55 | 10 | 1 |
| CP-4 | 22.5 | 21.25 | 6.25 | 0 | 0 | 2.5 |
| CP-5 | 22.5 | 21.25 | 6.25 | 0 | 0 | 3.75 |

| | | mole % 1,4-cyclohexane dicarboxylate | mole % glyceryl monosterate | mole % neopentyl glycol | mole % cyclohexane dimethanol | mole % tricyclodecane dimethanol |
|---|---|---|---|---|---|---|
| CP-1 | — | 42 | 0 | 0 | 50 | 0 |
| CP-2 | — | 0 | 0 | 0 | 0 | 0 |
| CP-3 | — | 0 | 1.5 | 0 | 0 | 0 |
| CP-4 | — | 0 | 0 | 22.5 | 22.5 | 0 |
| CP-5 | — | 0 | 2.5 | 17.5 | 12.5 | 16.25 |

*ethoxylated bisphenol-A (Akzo Chemical Co.)
**a fatty acid dimer diol (Unichema International)

* ethoxylated bisphenol-A (Akzo Chemical Co.)
**a fatty acid dimer diol (Unichema International)

TABLE 3

Composition for Control Polyesters Containing Less Than 3 wt % PDMS
8 mole % 5-sulfoisophthalate, Na salt, (DuPont Corp.)
42 mole % cyclohexanedicarboxylate
n mole % carbinol-terminated polydimethylsiloxane
50 - n mole % cyclohexane dimethanol, where n is adjusted to yield the desired wt % of siloxane

| | Carbinol-Terminated Polydimethylsiloxane | | |
|---|---|---|---|
| Example | Name | molecular weight | wt % |
| CP-6 | DMS-C15* | 1000 | 0.5 |
| CP-7 | DMS-C15 | 1000 | 2 |

TABLE 3-continued

Composition for Control Polyesters Containing Less Than 3 wt % PDMS
8 mole % 5-sulfoisophthalate, Na salt, (DuPont Corp.)
42 mole % cyclohexanedicarboxylate
n mole % carbinol-terminated polydimethylsiloxane
50 - n mole % cyclohexane dimethanol, where n is adjusted to yield the desired wt % of siloxane

| | Carbinol-Terminated Polydimethylsiloxane | | |
|---|---|---|---|
| Example | Name | molecular weight | wt % |
| CP-8 | DMS-C21* | 4500–5500 | 0.5 |
| CP-9 | DMS-C21 | 4500–5500 | 2 |

*available from Gelest, Inc. Tulleytown, PA.

* available from Gelest, Inc. Tulleytown, Pa.

Example 2

Water-dispersibility was determined for the invention and control polymers by stirring 20 g of solid polymer at 80° C. with 80 mL of distilled water for six hours. The resulting dispersions were filtered through polypropylene filter media. Results of how well these materials formed dispersions are summarized in Table 4 below.

TABLE 4

| Example | Water Dispersibility |
|---|---|
| E-1 | yes |
| E-2 | yes |
| E-3 | yes |
| E-4 | yes |
| E-5 | yes |
| E-6 | yes |
| CP-1 | yes |
| CP-2 | no |
| CP-3 | no |
| CP-4 | no |
| CP-5 | no |
| CP-6 | yes |
| CP-7 | yes |

TABLE 4-continued

| Example | Water Dispersibility |
|---|---|
| CP-8 | yes |
| CP-9 | yes |

The above data shows that polyesters containing dimethylsiloxane segments of the invention (E-1 through E-6) are water-dispersible, while control CP-2 through CP-5 were not. Although the control polyester containing no dimethylsiloxane segments (CP-1) and polyesters containing less than 2 wt % of the dimethylsiloxane segments (CP-6 through CP-9) did disperse, these materials failed the donor/receiver sticking test described in Example 3 below.

Example 3

Dye-receiving elements were prepared by first extrusion laminating a paper core with a 38 μm thick microvoided composite film (OPPalyte® 350TW, Mobil Chemical Co.) as disclosed in U.S. Pat. No. 5,244,861. The composite film side of the resulting laminate was then coated with the following layers in the order recited:

1) a subbing layer of 0.02 g/m$^2$ Polymin P® polyethyleneimine (BASF Corporation) coated from distilled water
2) and a dye-receiving layer composed of a mixture of 3.23 g/m$^2$ of aqueous dispersions of invention polyesters E-1 through E-6 prepared in Example 1 and 0.022 g/m$^2$ of a fluorocarbon surfactant (Fluorad FC-170C®, 3M Corporation), coated from distilled water.

Dye-donor elements were prepared by coating on a 6 μm poly(ethylene terephthalate) support (DuPont Co.):

1) a subbing layer of titanium tetra-n-butoxide (Tyzor TETO, DuPont Co.) (0.12 g/m$^2$) from a n-propyl acetate/l-butanol (85/15) solvent mixture, and
2) repeating yellow, magenta and cyan dye patches containing the compositions as described below.

The yellow composition contained 0.29 g/m$^2$ of Yellow Dye 1, 0.31 g/m$^2$ of CAP 482-20 (20 s viscosity cellulose acetate propionate, Eastman Chemical Co.), 0.076 g/m$^2$ of CAP 482-0.5 (0.5 s viscosity cellulose acetate propionate, Eastman Chemical Co.), 0.006 g/m$^2$ of 2 μm divinylbenzene crosslinked beads (Eastman Kodak Co.), and 0.0014 g/m$^2$ Of Fluorad FC-430®(3M Corporation) from a toluene/methanol/cylcopentanone solvent mixture (70/25/5).

The magenta composition contained 0.17 g/m$^2$ of Magenta Dye 1, 0.18 g/m$^2$ of Magenta Dye 2, 0.31 g/m$^2$ of CAP 482-20, 0.07 g/m$^2$ of 2,4,6-trimethylanilide of phenylindan-diacid 0.006 g/m$^2$ of 2 μm divinylbenzene crosslinked beads and 0.0011 g/m$^2$ of Fluorad FC-430® from a toluene/methanol/cylcopentanone solvent mixture (70/25/5).

The cyan composition contained 0.14 g/m$^2$ of Cyan Dye 1, 0.12 g/m$^2$ of Cyan Dye 2, 0.29 g/m$^2$ of Cyan Dye 3, 0.31 g/m$^2$ of CAP 482-20, 0.02 g/m$^2$ of CAP 482-0.5, 0.01 g/m$^2$ of 2 μm divinylbenzene crosslinked beads and 0.0007 g/m$^2$ of Fluorad FC-430® from a toluene/methanol/cylcopentanone solvent mixture (70/25/5).

On the backside of the donor element were coated the following layers in sequence:

1) a subbing layer of titanium tetra-n-butoxide (Tyzor TBT®, DuPont Co.) (0.12 g/m$^2$) from a n-propyl acetate/1-butanol (85/15) solvent mixture, and
2) a slipping layer containing 0.38 g/m$^2$ poly(vinyl acetal) (Sekisui Co.), 0.022 g/m$^2$ Candelilla wax dispersion (7% in methanol), 0.011 g/m$^2$ PS513 aminopropyl-dimethyl-terminated polydimethylsiloxane (Huels) and 0.003 g/m$^2$ p-toluenesulfonic acid coated from 3-pentanone (98%)/distilled water (2%) solvent mixture.

Preparation and Evaluation of Thermal Dye Transfer Images

Eleven-step sensitometric full color (yellow+magenta+cyan) thermal dye transfer images were prepared from the above dye-donor and dye-receiver elements. The dye side of the dye-donor element, approximately 10 cm×15 cm in area, was placed in contact with a receiving-layer side of a dye-receiving element of the same area This assemblage was clamped to a stepper motor-driven, 60 mm diameter rubber roller. A thermal head (IDK No. 8F10980, thermostatted at 25° C.) was pressed with a force of 24.4 Newton (2.5 kg) against the dye-donor element side of the assemblage, pushing it against the rubber roller.

The imaging electronics were activated causing the donor-receiver assemblage to be drawn through the printing head/roller nip at 40.3 mm/sec. Coincidentally, the resistive elements in the thermal print head were pulsed for 127.75 μs/pulse at 130.75 μs intervals during a 4.575 ms/dot printing cycle (including a 0.391 ms/dot cool down interval). A stepped image density was generated by incrementally increasing the number of pulses/dot from a minimum of 0 to a maximum of 32 pulses/dot. The voltage supplied to the thermal head was approximately 14.0 v resulting in an instantaneous peak power of 0.369 watts/dot and a maximum total energy of 1.51 mJ/dot; print room humidity: 42% RH.

The above printing procedure was done using the yellow, magenta and cyan dye-donor patches. When properly registered, a full color image was obtained. During the printing process, the level of donor-to-receiver sticking was determined visually and rank ordered. A 0 indicates no donor-receiver sticking was observed, a 3 indicates medium levels of sticking and a 5 indicates severe sticking. In addition, the optical densities for yellow, magenta and cyan channels at Dmax (step 11) were measured using an X-Rite 820° densitometer (X-Rite Corp.). The results are summarized in Table 5 below.

TABLE 5

Ranking of Donor-to-Receiver Sticking

| Example | Donor-to-Receiver Sticking Rank | Yellow Dmax | Magenta Dmax | Cyan Dmax |
|---|---|---|---|---|
| E-1 | 3 | 1.94 | 1.80 | 1.78 |
| E-2 | 3 | 1.93 | 1.70 | 1.80 |
| E-3 | 1 | 1.97 | 1.62 | 1.74 |
| E-4 | 4 | 1.74 | 1.49 | 1.65 |
| E-5 | 4 | 1.84 | 1.73 | 1.73 |
| E-6 | 3 | 1.84 | 1.73 | 1.82 |
| CP-1 | 5 | * | * | * |
| CP-6 | 5 | * | * | * |
| CP-7 | 5 | * | * | * |
| CP-8 | 5 | * | * | * |
| CP-9 | 5 | * | * | * |

*donor-receiver sticking was severe and OD of dyes could not be measured.

* donor-receiver sticking was severe and OD of dyes could not be measured.

The above data show that incorporation of dimethylsiloxane segments at levels greater than 2 wt-% (E-1 through E-6) into aqueous coatable polyester ionomers significantly reduced the amount of donor-receiver sticking -relative to polyester ionomers that did not contain these segments (CP-1). In addition, the D-max values for all receivers of the invention (E-1 through E-6) were acceptable. Polyester ionomers that contained 2 wt-% or less of the dimethylsiloxane segments (CP-6 through CP-9) showed no improvements in donor-receiver sticking.

The invention has been described in detail with particular reference to preferred embodiments thereof, but it will be understood that variations and modifications can be effected within the spirit and scope of the invention.

What is claimed is:

1. A dye-receiving element for thermal dye transfer comprising a support having on one side thereof a dye image-receiving layer comprising a water-dispersible polyester comprising 3 to 20 wt-% carbinol-terminated dimethylsiloxane, said dye image-receiving layer containing a thermally-transferred dye image.

2. The element of claim 1 wherein said water-dispersible polyester is a condensation type polyester of the following structure:

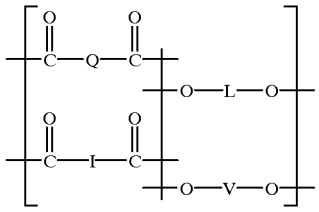

wherein:

Q represents an alkyl dicarboxylic acid, an aromatic dicarboxylic acid or one or more alicyclic rings containing dicarboxylic acid units with each carboxyl group within two carbon atoms of the alicyclic ring; comprising 70 to 90 mole-% of the dibasic diacid repeat units;

I represents an ionic dibasic dicarboxylic acid and comprises 30 to 10 mole-% of the dibasic diacid repeat units;

V represents a carbinol-terminated polydimethylsiloxane segment, where the mole-% is sufficient to yield a final polymer with 3 to 20 wt-% polydimethylsiloxane; and L comprises the balance of the mole-% and represents an alkylene diol, one or more aromatic rings with a hydroxyl group within two carbon atoms of the aromatic ring, or one or more alicyclic rings with a hydroxyl group within two carbon atoms of the alicyclic ring.

3. The element of claim 2 wherein V has the following formula:

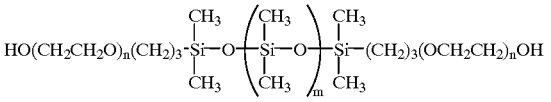

wherein n and m are selected so that the molecular weight is between 500 and 10,000 and the weight % of nonsiloxane components is between 2 and 25.

4. The element of claim 2 wherein Q is an alicyclic ring having from 4 to 10 ring carbon atoms.

5. The element of claim 4 wherein the alicyclic ring of Q has 6 ring carbon atoms.

6. The element of claim 2 wherein L contains an alicyclic ring.

7. The element of claim 1 wherein said polyester has a weight average molecular weight of from about 10,000 to about 250,000.

8. The element of claim 7 wherein said polyester has a weight average molecular weight of from about 20,000 to about 100,000.

9. The element of claim 1 wherein said polyester has a glass transition temperature between about 0° C. and about 120° C.

10. The element of claim 9 wherein said polyester has a glass transition temperature between about 0° C. and about 60° C.

11. The element of claim 2 wherein Q represents a dicarboxylic acid derived from 1,4-cyclohexanedicarboxylic acid and L represents units derived from 20 to 100 mole percent 1,4-cyclohexanedimethanol.

12. The element of claim 2 wherein the dicarboxylic acid derived units of I are derived from monomers which contain metal ion salts of sulfonic acids or iminodisulfonyl groups.

13. A process of forming a dye transfer image comprising imagewise-heating a dye-donor element comprising a support having thereon a dye layer and transferring a dye image to a dye-receiving element to form said dye transfer image, said dye-receiving element comprising a support having thereon a dye image-receiving layer comprising a water-dispersible polyester comprising 3 to 20 wt-% carbinol-terminated dimethylsiloxane.

14. The process of claim 13 wherein said water-dispersible polyester is a condensation type polyester of the following structure:

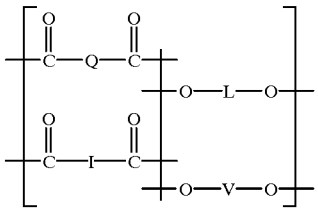

wherein:

Q represents an alkyl dicarboxylic acid, an aromatic dicarboxylic acid or one or more alicyclic rings containing dicarboxylic acid units with each carboxyl group within two carbon atoms of the alicyclic ring; comprising 70 to 90 mole-% of the dibasic diacid repeat units;

I represents an ionic dibasic dicarboxylic acid and comprises 30 to 10 mole-% of the dibasic diacid repeat units;

V represents a carbinol-terminated polydimethylsiloxane segment, where the mole-% is sufficient to yield a final polymer with 3 to 20 wt-% polydimethylsiloxane; and L comprises the balance of the mole-% and represents an alkylene diol, one or more aromatic rings with a hydroxyl group within two carbon atoms of the aromatic ring, or one or more alicyclic rings with a hydroxyl group within two carbon atoms of the alicyclic ring.

15. The process of claim 14 wherein V has the following formula:

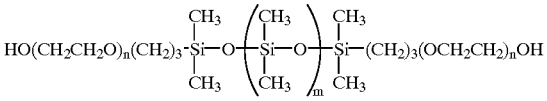

wherein n and m are selected so that the molecular weight is between 500 and 10,000 and the weight % of nonsiloxane components is between 2 and 25.

16. The process of claim 14 wherein the alicyclic ring of Q has 6 ring carbon atoms.

17. A thermal dye transfer assemblage comprising: (a) a dye-donor -[]element comprising a support having thereon a dye layer, and (b) a dye-receiving element comprising a support having thereon a dye image-receiving layer, said dye-receiving element being in a superposed relationship with said dye-donor element so that said dye layer is in contact with said dye image-receiving layer; wherein said dye image-receiving layer comprises a water-dispersible polyester comprising 3 to 20 wt-% carbinol-terminated dimethylsiloxane.

18. The assemblage of claim 17 wherein said water-dispersible polyester is a condensation type polyester of the following structure:

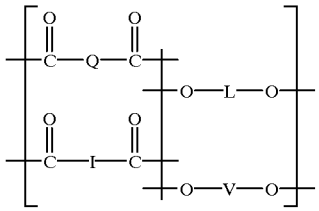

wherein:

Q represents an alkyl dicarboxylic acid, an aromatic dicarboxylic acid or one or more alicyclic rings containing dicarboxylic acid units with each carboxyl group within two carbon atoms of the alicyclic ring; comprising 70 to 90 mole-% of the dibasic diacid repeat units;

I represents an ionic dibasic dicarboxylic acid and comprises 30 to 10 mole-% of the dibasic diacid repeat units;

V represents a carbinol-terminated polydimethylsiloxane segment, where the mole-% is sufficient to yield a final polymer with 3 to 20 wt-% polydimethylsiloxane; and L comprises the balance of the mole-% and represents an alkylene diol, one or more aromatic rings with a hydroxyl group within two carbon atoms of the aromatic ring, or one or more alicyclic rings with a hydroxyl group within two carbon atoms of the alicyclic ring.

19. The assemblage of claim 17 wherein V has the following formula:

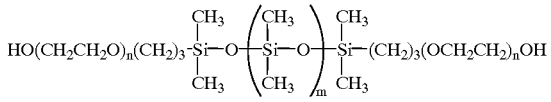

wherein n and m are selected so that the molecular weight is between 500 and 10,000 and the weight % of nonsiloxane components is between 2 and 25.

20. The assemblage of claim 17 wherein the alicyclic ring of Q has 6 ring carbon atoms.

* * * * *